US005222864A

United States Patent [19]

Pearce

[11] Patent Number: 5,222,864

[45] Date of Patent: Jun. 29, 1993

[54] CEILING FAN

[75] Inventor: Richard A. Pearce, Memphis, Tenn.

[73] Assignee: Hunter Fan Company, Memphis, Tenn.

[21] Appl. No.: 767,064

[22] Filed: Sep. 27, 1991

[51] Int. Cl.[5] ..... F01D 25/00

[52] U.S. Cl. ..... 416/5; 416/170 R; 248/344

[58] Field of Search ..... 415/5; 416/244 R, 246, 416/204 R, 205, 5, 170 R; 248/343, 344, 345; 417/572

[56] References Cited

U.S. PATENT DOCUMENTS

| | | | |
|---|---|---|---|
| 866,292 | 9/1907 | Meston . | |
| 1,241,245 | 9/1917 | Parker | 416/5 |
| 1,671,404 | 5/1928 | Cherry . | |
| 2,079,942 | 5/1937 | Le Velle . | |
| 2,119,398 | 5/1938 | Morse | 416/5 |
| 2,749,074 | 6/1956 | Bodian | 248/344 |
| 4,342,073 | 7/1982 | Ranten | 416/5 |
| 4,357,506 | 11/1982 | Breining . | |
| 4,382,400 | 5/1983 | Stutzman . | |
| 4,402,649 | 9/1983 | Laurel | 416/5 |
| 4,518,314 | 5/1985 | Schultz | 416/5 |
| 4,634,345 | 1/1987 | Stanek et al. . | |
| 4,729,725 | 3/1988 | Markwardt | 416/246 |
| 4,878,806 | 11/1989 | Markwardt . | |
| 4,884,947 | 12/1989 | Rezek . | |
| 4,900,236 | 2/1990 | Kapaan . | |
| 4,930,989 | 6/1990 | Mosiewicz | 416/209 |

FOREIGN PATENT DOCUMENTS

| | | | |
|---|---|---|---|
| 0101292 | 6/1983 | Japan | 416/246 |
| 715925 | 5/1954 | United Kingdom . | |
| 783431 | 9/1957 | United Kingdom . | |
| 1508076 | 4/1978 | United Kingdom . | |

*Primary Examiner*—Edward K. Look
*Assistant Examiner*—Mark Sgantzos
*Attorney, Agent, or Firm*—Heiskell, Donelson, Bearman, Adams, Williams & Kirsch

[57] ABSTRACT

A ceiling fan is provided, having an electric motor with separate stationary and rotating members, the outer extremities of the rotating member being defined by upper, lower, and side surfaces, with a plurality of radially extending blades being secured to the upper surface. The ceiling fan also includes a tube member securable to the stationary member of the motor for pivotally suspending the ceiling fan from the ceiling, and at least one electrical switch for selectively controlling the operation of the motor. A unitary housing is provided, securable to the stationary member of the motor, for enclosing at least the lower and side surfaces of the motor in a first compartment thereof, and enclosing the electrical switch in a second compartment thereof.

22 Claims, 4 Drawing Sheets

CEILING FAN

BACKGROUND OF THE INVENTION

1. Field

The present invention relates to ceiling fans and, more particularly, to ceiling fans having a unitary motor and switch housing.

2. Description of the Prior Art

Electric ceiling fans are commonly utilized to assist heating and air conditioning systems by providing an additional degree of air circulation within the confines of a room. A typical ceiling fan comprises a motor suspendable from a ceiling, a housing surrounding such motor, a switch (or switches) for allowing selective control of the motor, a separate housing for the switch, and a plurality of blades attached to the motor. Generally speaking, modern ceiling fans can be broadly categorized into two groups: those having blades attached to the bottom surface of the motor, an those having blades attached to the top surface of the motor. An example of the former category is shown in U.S. Pat. No. 4,729,725, issued Mar. 8, 1988, entitled "Mounting System for Selectively Mounting Ceiling Fans", while an example of the second category is shown in U.S. Pat. No. 4, 518,314, issued May 21, 1985, entitled "Decorative Fan Motor Cover and Mounting Structure Therefore".

As exemplified in the above referenced U.S. patents, ceiling fans typically include a multicomponent housing, comprising an upper housing member for encasing at least the exposed side and lower surfaces of the motor, and a second housing member for encasing the switches employed to control the operation of the fan motor. The '314 patent illustrates a typical assembly for a fan having top mounted blades, which includes a plurality of housing members secured by a collection of plates, panels, brackets, screws, and other miscellaneous hardware.

As illustrated in the above referenced '725 patent, modern ceiling fans are typically suspended by means of a ball and socket arrangement, wherein a ball, or at least a portion thereof, is secured to the upper end of a rod and is seated in a socket, or hole, formed in a canopy secured to the ceiling. The lower end of the rod is secured to the fan motor, typically by means of a pin and retaining clip or a screw and a nut. Such arrangements generally require an additional adaptor component for providing a method of attachment between the lower end of the hanger rod and the fan motor.

The above-referenced patents also illustrate the well-known construction technique for ceiling fans of virtually all types, wherein the blades are attached to the motor by means of individual brackets commonly referred to as blade irons. Such blade irons typically comprise a functional and decorative component of the fan, having one end secured to the blade by two or three screws, with the other end being similarly attached to the motor by two additional screws. Blade irons serve not only as attachment means for securing the blades to the motor, but also as mechanisms for establishing a desired angle of attack for the blades in order to provide the necessary degree of air displacement. Conventional blade irons add to the cost of ceiling fans and occasionally break, thereby resulting in a potentially hazardous situation.

There is a need in the art for a simplified ceiling fan construction, so that the number of components necessary to comprise an attractive and functional housing is minimized. There is a similar need in the art for a simplified hanging system, and for a simplified and less hazardous blade attachment method.

BRIEF SUMMARY OF THE INVENTION

This invention provides a unique ceiling fan assembly having a unitary housing structure for enclosing both the motor and switching mechanisms, wherein the ceiling blades are attached to the top surface of the motor. This invention also provides a simplified hanging structure for ceiling fans, having a hanging rod with an upper end pivotally mounted within a canopy, and a lower end attached directly to the fan motor without necessitating additional adapters or connecting devices. The unitary housing provided by this invention includes a removable bottom cover for allowing access to the interior of the housing from below. The blades in this invention are mounted directly to the motor without blade irons, and are maintained at a desired angle by wedge shaped members disposed between the blades and the motor.

A primary objective of this invention is to provide a ceiling fan having a combined motor and switch housing composed of a minimum number of components in order to simplify assembly and lower the cost of the unit. It is a further object of this invention to provide a ceiling fan having a housing which is sufficiently inexpensive and easily replaceable, thereby making feasible the use of multiple interchangeable housings having a variety of external configurations and/or colors. A still further object of this invention is to provide a ceiling fan having simplified means for attaching a plurality of blades to the top surface of the motor thereof. These and other objects of the present invention will become apparent from the reading of the following specification, taken in conjunction with the enclosed drawings.

DETAILED DESCRIPTION OF THE PREFERRED EMBODIMENT

Figure 1:
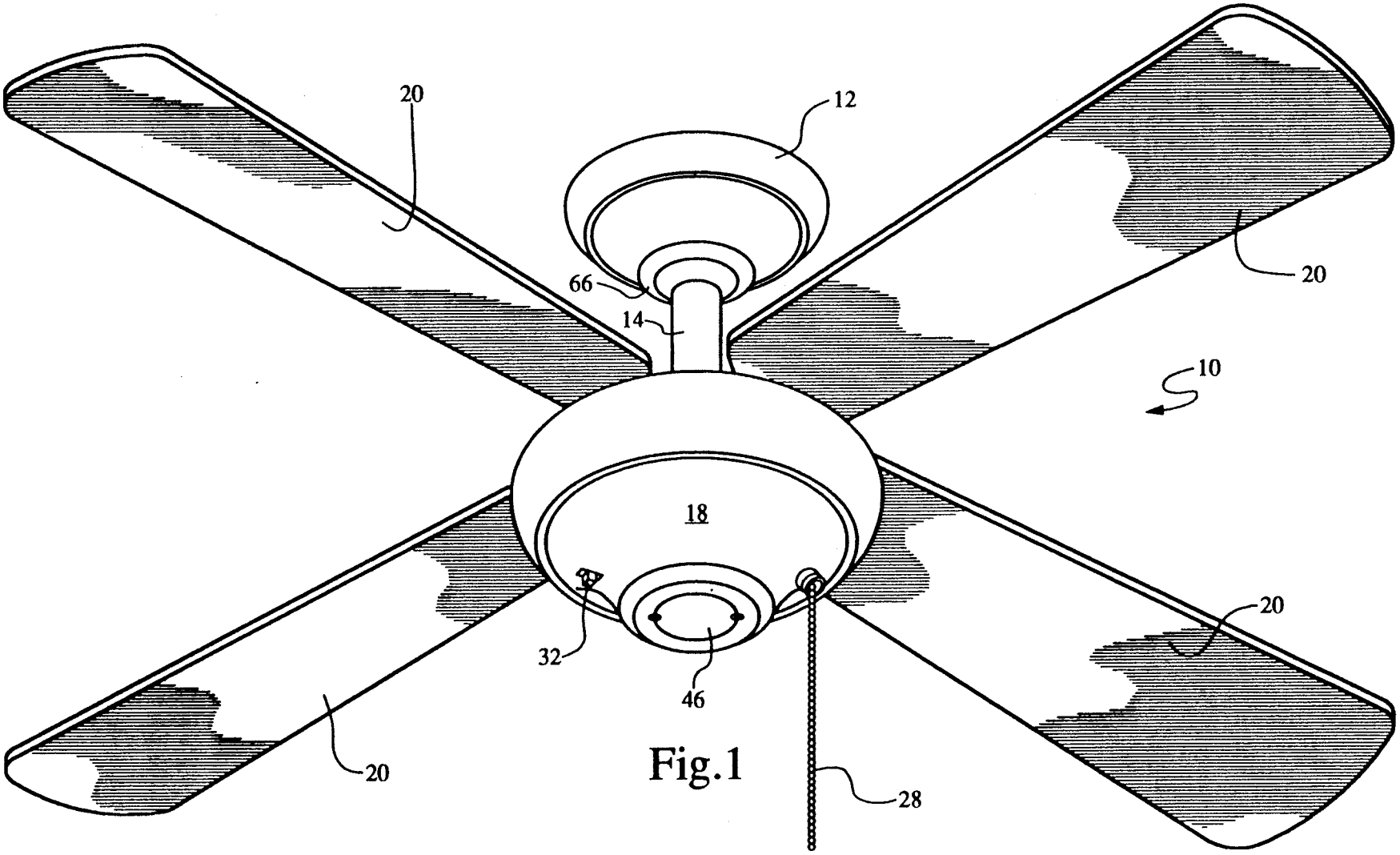
FIG. 1 is a perspective view of a representative ceiling fan of the present invention.
Figure 2:
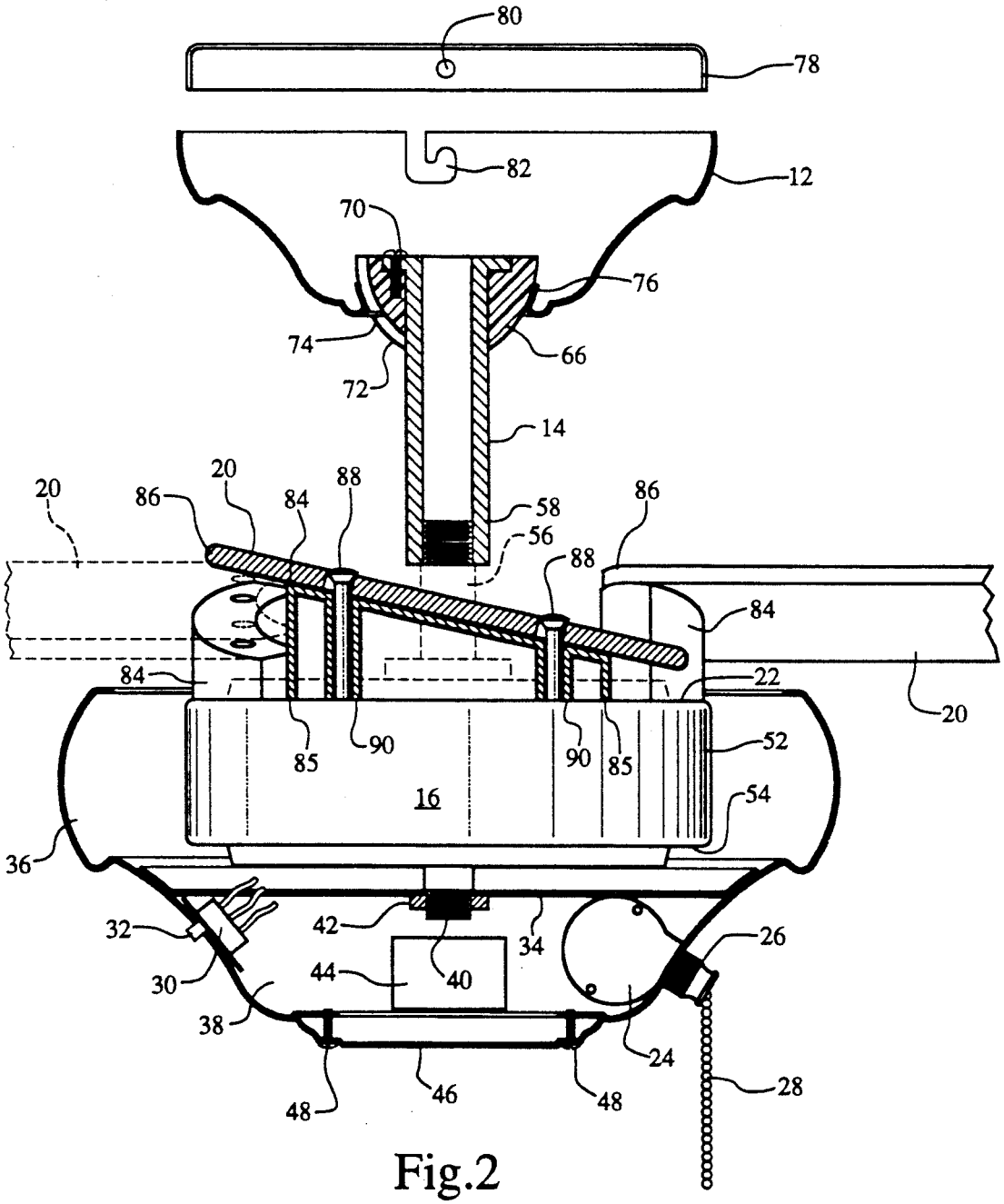
FIG. 2 is a side elevational view, partially in section, of the preferred embodiment of the present invention.

Referring initially to FIGS. 1 and 2, ceiling fan 10 of the present invention comprises canopy 12 having tube 14 (commonly referred to as a down rod or hangar rod) pivotally suspended therefrom, electric motor 16 secured to tube 14, housing 18, and a plurality of blades 20 secured to the upper surface 22 of motor 16. In the preferred embodiment shown, ceiling fan 10 includes a speed control switch 24 secured to housing 18 by nut 26 and selectively operable by pulling chain 28, and directional control switch 30 selectively operable by button 32 for controlling the rotational direction of motor 16. It will be well understood by those skilled in the art upon reading this disclosure that the advantages of the present invention may be realized regardless of the number or configuration of switching mechanisms employed, and that conventional switches 24 and 30 are displayed primarily by way of example and should not constitute a limitation on the scope of this invention.

The preferred embodiment of ceiling fan 10 is illustrated in FIG. 2, wherein housing 18 includes an internal panel 34 which effectively divides housing 18 into an upper compartment 36 and a lower compartment 38. Panel 34 has a generally centrally located hole formed therethrough for receiving externally threaded member 40, a stationary component of motor 16. Nut 42 is threaded onto member 40, thereby removably securing housing 18 to motor 16. Panel 34 is preferably welded to housing 18, but may be secured by any suitable means. Upper compartment 36 effectively encloses the side and lower surfaces of motor 16, while lower compartment 38 encloses switches 24 and 30 and any other necessary components (such as a capacitor) illustrated generally at 44. Plate 46 is removably secured to the lower portion of housing 18 by means of screws 48 to cover access opening 50. Opening 50 is provided to allow ready access to nut 42 so that housing 18 may be easily installed, and conveniently removed and replaced when desired by the user.

Electric motor 16 is substantially conventional, comprising a generally round outer side surface 52, and generally flat upper surface 22 and lower surface 54. Motor 16 further comprises a stationary member which includes threaded member 40 as mentioned above, as well as externally threaded member 56. Upon operation of motor 16, the outer portion defined by side surface 52, upper surface 22, and lower surface 54 rotates about the central stationary portion which includes threaded members 40 and 56. The electrical aspects of motor 16 are conventional, and will be well understood by those skilled in the art.

Figure 5:
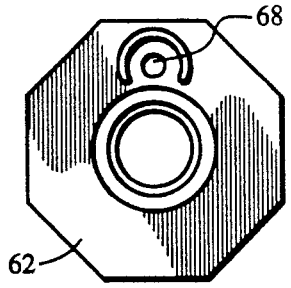
FIG. 5 is an end elevational view of the hanging tube shown in FIG. 4.
Figure 6:
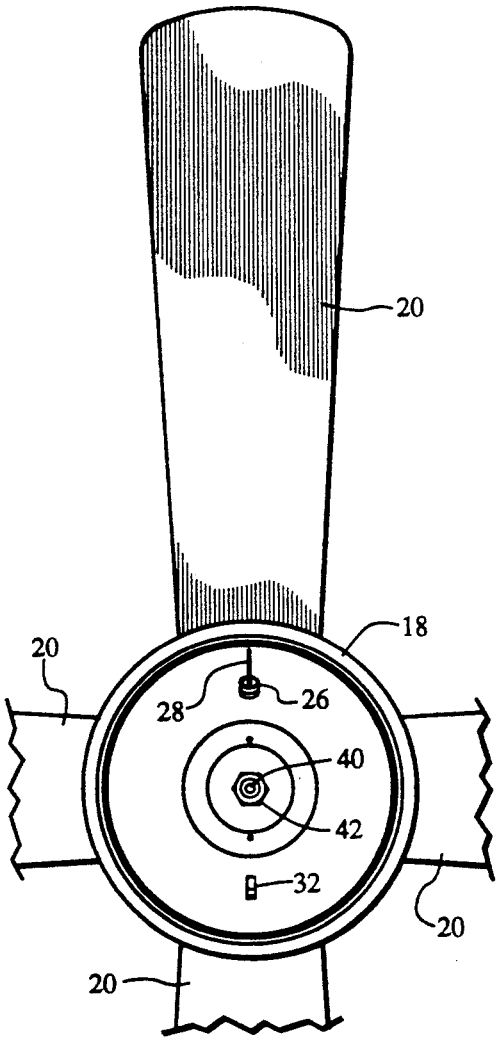
FIG. 6 is a bottom plan view of a representative ceiling fan housing of the present invention, with the bottom cover member removed.
Figure 7:
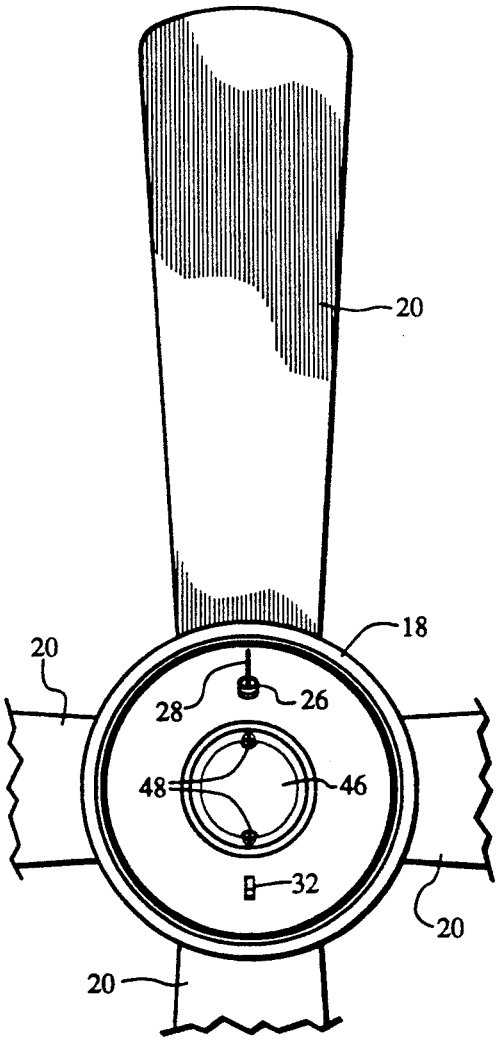
FIG. 7 is a bottom plan view similar to FIG. 6, but with the bottom cover member installed.

By providing external threads on member 56, motor 16 may be secured directly to the internal threaded lower end 58 of tube 14 without necessitating the use of any additional fastening devices. Upper end 60 of tube 14 has flange 62 and at least one finger 64 integrally formed therewith, for engaging the suitably formed opening through ball member 66. Flange 62 serves to support tube 14, thereby preventing tube 14 from passing completely through the centrally located hole in ball member 66, while fingers 64 prevent tube 14 from rotating relative to ball member 66. Preferably, flange 62 is hexagonally shaped as shown in FIG. 5, and rod 14 includes at least four fingers 64. One of such fingers 64 includes a threaded hole 68 formed therein, for engaging screw 70 which may be employed as a ground element for motor 16. Ball member 66 has slot 72 formed therein for receiving prong 74 formed in canopy 12, thereby preventing relative rotation between ball member 66 and canopy 12.

It has been found that superior strength and cost effectiveness may be obtained by die casting tube 14 and flange 62 together as a single unit; other manufacturing techniques may also yield acceptable results.

Figure 3:
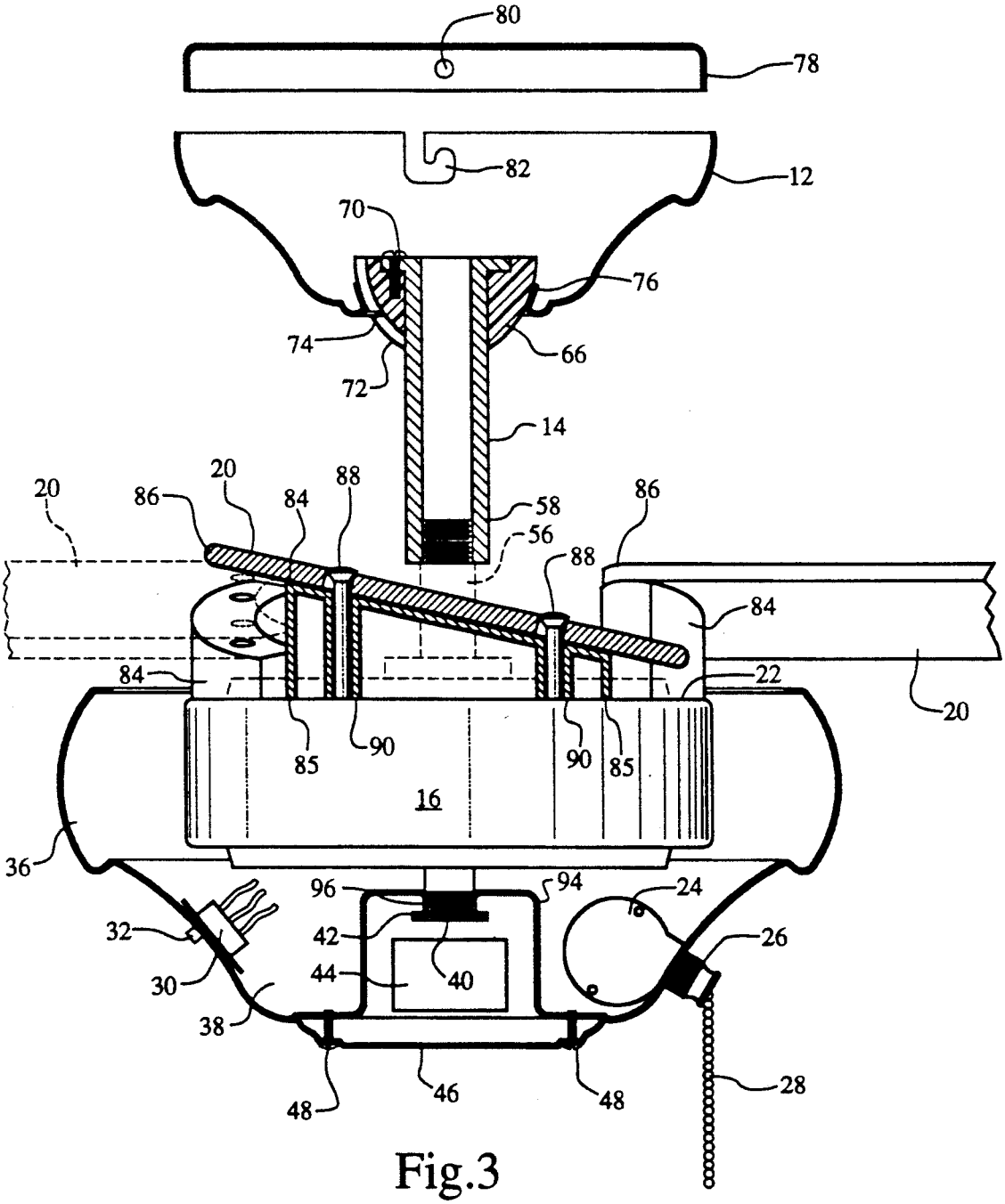
FIG. 3 is a side sectional view similar to FIG. 2 of an alternative embodiment of the present invention.
Figure 4:
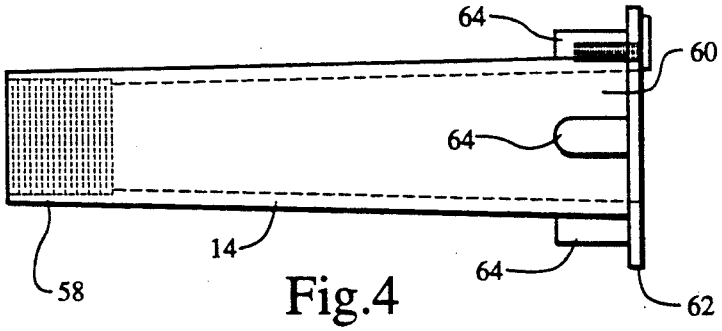
FIG. 4 is a side elevational view of the hanging tube of the present invention.

As clearly shown in FIGS. 2 and 3, ball member 66 seats within socket 76 formed in canopy 12, thereby enabling ceiling fan 10 to pivot slightly relative to canopy 12 as necessary. Mounting plate 78 is rigidly securable to a ceiling by conventional means (not shown), with canopy 12 being removably secured thereto by suitable means. Preferably, mounting plate 78 includes a plurality of pins 80 extending therefrom for operatively engaging receptacles 82 formed in the upper perimeter of canopy 12. Prong 74 preferably comprises a small segment of socket 76 formed in a generally horizontal position.

Blades 20 comprise substantially planar sections of wood or other suitable material. As is well known in the art, blades 20 must be maintained at an angle other than 90° relative to the axis of rotation for motor 16 in order to effect adequate air movement. Accordingly, generally wedge shaped members 84 are operatively disposed between the proximate ends 86 of blades 20 and the upper surface 22 of motor 16. As illustrated in FIGS. 2 and 3, each of ends 86 has a pair of holes formed therethrough for receiving screws 88 which engage suitable threaded holes (not shown) formed in upper surface 22 of motor 16, thereby securing blades 20 and members 84 to motor 16. Members 84 are preferably formed of a suitably rigid and light plastic material, having a substantially hollow interior with cylindrical channels 90 formed therein for receiving screws 88. Members 84 eliminate the need for conventional blade irons, which are considerably more costly and prone to breakage.

As illustrated in FIGS. 2 and 3, the bottom surface of each member 84 consists of the lower edges 85 of the front, back and end walls, and the lower edges of cylindrical channels 9. All such lower edges effectively create a substantially planar bottom surface for member 84 suitable for fitting flush against upper surface 22 of motor 16. The top surface of member 84, which is formed at a suitable angle relative to the plane defined by the lower edges 85, is also substantially flat to fit flush against the bottom surface of proximate end 86 of blade 20. In the preferred embodiment shown, the outer surface of each member 84 is curved to generally conform to the shape of outer side surface 52 of motor 16. The inner surface of each member 84 may also be curved, as shown, to conform generally with the concave distal end 86 of blade 20. It will be readily understood by those skilled in the art that many variations in the precise structure and configuration of members 84 may be adopted without departing from the spirit and scope of this invention.

FIG. 3 illustrates an alternative embodiment of the present invention, wherein housing 92 includes a cup-like compartment 94 integrally formed therewith, thereby eliminating the need for a separate panel 34. Nut 42 is similarly employed to secure housing 92 onto threaded member 40 by supporting the edges of hole 96 formed in compartment 94. All other aspects of the alternative embodiment are identical to the preferred embodiment discussed in detail above.

Those skilled in the art will fully appreciate the fact that housings 18 and 92 and plate 46 may be formed from a number of suitable metal or plastics materials, and may be provided in a wide variety of colors. It will also be understood that plate 46 may be removed and replaced with any number of different lighting kits suitable for the purpose. The foregoing detailed description of a preferred and alternative embodiment is to be clearly understood as being given by way of illustration and example only, the spirit and scope of the present invention being limited solely by the appended claims.

What is claimed is:

1. A ceiling fan comprising:

an electric motor having upper, lower, and side surfaces, said motor comprising a stationary member and a rotating member, said rotating member being selectively rotatable upon operation of said motor;

switch means for selectively controlling the operation of said motor;

a plurality of radially extending blades, removably secured to said rotating member adjacent said upper surface of said motor;

a unitary housing removably securable to said stationary member of said motor, for enclosing at least said lower and side surfaces of said motor, said housing being integrally configured to provide at least two compartments, the first of said compartments being suitable for substantially encasing said motor and the second of said compartments being suitable for substantially encasing said switch means;

a plate member fixedly securable to a ceiling;

a canopy removably securable to said plate member, having a centrally located hole formed therethrough;

a rod having longitudinally opposed first and second ends, said first end having a contiguous annular flange extending radially therefrom, said second end having attachment means associated therewith for attaching said rod to said motor;

a ball member, comprising a generally flat upper surface and a spherical lower surface, having a centrally located, vertically disposed hole formed therethrough for receiving said rod, said generally flat upper surface being adapted to engage said flange thereby preventing said rod from falling downwardly through said hole in said ball member, wherein said spherical lower surface of said ball member is adapted to pivotally engage said hole in said canopy such that a portion of said ball member protrudes from said canopy, with said first end of said rod being retained within said canopy and said second end of said rod extending there below; and means for preventing rotation of said ball member within said hole in said canopy about a vertical axis.

2. A ceiling fan as set forth in claim 1, wherein said means for preventing rotation of said ball member comprise:

a vertical slot formed in the surface of said ball member; and a tab formed in the rim of said hole in said canopy, said tab being adapted to engage said slot in said ball member, thereby preventing rotation of said ball member about a vertical axis yet allowing pivotal movement of said ball within said hole in said canopy.

3. A ceiling fan as set forth in claim 1, wherein:

said attachment means associated with said second end of said rod comprise screw threads.

4. A ceiling fan as set forth in claim 1, wherein said rod and said annular flange are die cast together as a single component.

5. A ceiling fan as set forth in claim 1, wherein said flange includes grounding means associated therewith for providing an electrical ground for said motor.

6. A ceiling fan as set forth in claim 5, wherein said grounding means comprise a threaded hole formed in said flange, and a suitable screw for threadingly engaging said hole, thereby securing a grounding wire to said flange.

7. A ceiling fan as set forth in claim 1, wherein said rod further includes means associated therewith for preventing rotation of said rod within said hole in said ball member.

8. A ceiling fan as set forth in claim 7, wherein said means for preventing rotation of said rod within said hole in said ball member comprise at least one lug member integrally formed on said rod adjacent said first end thereof, said at least one lug member being configured to engage said ball member, thereby preventing relative rotational movement between said rod and said ball member.

9. A ceiling fan as set forth in claim 8, wherein said ball member is at least one receptacle formed therein, the number of said receptacles being equal to the number of said lug members, said at least on receptacle being adapted to receive said at least on lug member, thereby providing a more positive engagement between said ball member and said rod.

10. A ceiling fan as set forth in claim 8, wherein the number of said lug members is four.

11. A ceiling fan as set forth in claim 10, wherein said lugs are evenly spaced at substantially 90 intervals around said first end of said rod.

12. A ceiling fan, comprising:

an electric motor having upper, lower, and side surfaces, said motor comprising a stationary member and a rotating member, said rotating member being selectively rotatable upon operation of said motor;

means for suspending said motor from a ceiling, securable to said stationary member, comprising a plate member fixedly securable to a ceiling;

a canopy removably securable to said plate member, having a centrally located hole formed therethrough;

a rod having longitudinally opposed first and second ends, said first end having a contiguous annular flange extending radially therefrom, said second end having attachment means associated therewith for attaching said rod to said stationary member;

a ball member, comprising a generally flat upper surface and a spherical lower surface, having a centrally located, vertically disposed hole formed therethrough for receiving said rod, said generally flat upper surface being adapted to engage said flange thereby preventing said rod from falling downwardly through said hole in said ball member, wherein said spherical lower surface of said ball member is adapted to pivotally engage said hole in said canopy such that a portion of said ball member protrudes from said canopy, with said first end of said rod being retained within said canopy and said second end of said rod extending there below; and means for preventing rotation of said ball member within said hole in said canopy about a vertical axis;

switch means for selectively controlling the operation of said motor;

a plurality of radially extending blades, removably secured to said rotating member adjacent said upper surface of said motor; and a unitary housing removably securable to said stationary member of said motor by suitable fastening means, for enclosing at least said lower and side surfaces of said motor, said housing having an internal member formed therein for dividing said housing into at least two compartments, the first of said compartments being suitable for substantially encasing said lower and side surfaces of said motor and the second of said compartments being suitable for enclosing said fastening means.

13. A ceiling fan as set forth in claim 12, wherein said means for preventing rotation of said ball member comprise:

a vertical slot formed in the surface of said ball member; and a tab formed in the rim of said hole in said canopy, said tab being adapted to engage said slot in said ball member, thereby preventing rotation of said ball member about a vertical axis yet allowing pivotal movement of said ball within said hole in said canopy.

14. A ceiling fan as set forth in claim 12, wherein:

said attachment means associated with said second end of said rod comprise screw threads.

15. A ceiling fan as set forth in claim 12, wherein said rod and said annular flange are die cast together as a single component.

16. A ceiling fan as set forth in claim 12, wherein said flange includes grounding means associated therewith for providing an electrical ground for said motor.

17. A ceiling fan as set forth in claim 16, wherein said grounding means comprise a threaded hole formed in said flange, and a suitable screw for threadingly engaging said hole, thereby securing a grounding wire to said flange.

18. A ceiling fan as set forth in claim 12, wherein said rod further includes means associated therewith for preventing rotation of said rod within said hole in said ball member.

19. A ceiling fan as set forth in claim 18, wherein said means for preventing rotation of said rod within said hole in said ball member comprise at least one lug member integrally formed on said rod adjacent said first end thereof, said at least one lug member being configured to engage said ball member, thereby preventing relative rotational movement between said rod and said ball member.

20. A ceiling fan as set forth in claim 19, wherein said ball member is at least one receptacle formed therein, the number of said receptacles being equal to the number of said lug members, said at least one receptacle being adapted to receive said at least on lug member, thereby providing a more positive engagement between said ball member and said rod.

21. A ceiling fan as set forth in claim 19, wherein the number of said lug members is four.

22. A ceiling fan as set forth in claim 21, wherein said lugs are evenly spaced at substantially 90° intervals around said first end of said rod.

* * * * *